US007185633B2

(12) United States Patent
Watanabe

(10) Patent No.: US 7,185,633 B2
(45) Date of Patent: Mar. 6, 2007

(54) CONTROL APPARATUS FOR INTERNAL COMBUSTION ENGINE

(75) Inventor: Takashi Watanabe, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/319,391

(22) Filed: Dec. 29, 2005

(65) Prior Publication Data

US 2006/0174856 A1 Aug. 10, 2006

(30) Foreign Application Priority Data

Feb. 4, 2005 (JP) ..... 2005-028805

(51) Int. Cl.
*F02D 41/30* (2006.01)

(52) U.S. Cl. ..... 123/431; 123/480

(58) Field of Classification Search ..... 123/294, 123/295, 430, 431, 478, 480
See application file for complete search history.

(56) References Cited

U.S. PATENT DOCUMENTS

| | | | |
|---|---|---|---|
| 5,181,493 | A | 1/1993 | Motoyama et al. |
| 6,401,703 | B1 | 6/2002 | Mamiya et al. |
| 6,606,976 | B2 * | 8/2003 | Nagano et al. ..... 123/431 |

FOREIGN PATENT DOCUMENTS

| | | |
|---|---|---|
| DE | 198 53 799 A1 | 5/2000 |
| EP | 1 088 978 A2 | 4/2001 |
| JP | A 63-255539 | 10/1988 |
| JP | 4-31647 | 2/1992 |
| JP | A 5-086941 | 4/1993 |
| JP | A 10-103118 | 4/1998 |
| JP | 11-182305 | 7/1999 |

* cited by examiner

*Primary Examiner*—T. M. Argenbright
(74) *Attorney, Agent, or Firm*—Oliff & Berridge, PLC

(57) ABSTRACT

It is determined whether an internal combustion engine is in an idle state or in a non-idle state based on the throttle opening degree. DI ratio control for controlling fuel injection ratio between in-cylinder injection and port injection is performed in accordance with different control modes in the idle state and in the non-idle state. While the DI ratio control mode is basically switched according to transition between the idle and non-idle states, in the engine cold state where fuel deposition disturbing air-fuel ratio control is likely to occur, a transition delay period is provided upon transition from the non-idle state to the idle state. During the transition delay period, the control mode is fixed irrespective of the transition between the idle and non-idle states. This prevents intermittent changes of the DI ratio, and thus, prevents variation in engine output.

8 Claims, 3 Drawing Sheets

CONTROL APPARATUS FOR INTERNAL COMBUSTION ENGINE

This nonprovisional application is based on Japanese Patent Application No. 2005-028805 filed with the Japan Patent Office on Feb. 4, 2005, the entire contents of which are hereby incorporated by reference.

BACKGROUND OF THE INVENTION

1. Field of the Invention

The present invention relates to a control apparatus for an internal combustion engine, and more particularly to fuel injection ratio setting control in an internal combustion engine provided with a first fuel injection mechanism (in-cylinder injector) for injecting fuel into a cylinder and a second fuel injection mechanism (intake manifold injector) for injecting fuel into an intake manifold and/or an intake port.

2. Description of the Background Art

In an internal combustion engine having both an in-cylinder injector for directly injecting fuel into a combustion chamber of a corresponding cylinder and an intake manifold injector for injecting fuel into an intake port of a corresponding cylinder, a configuration for controlling a fuel injection ratio between the two kinds of injectors in accordance with an operation state during a homogeneous combustion operation is known (e.g., Japanese Patent Laying-Open No. 10-103118; hereinafter, also referred to as "Patent Document 1"). In particular, Patent Document 1 proposes a configuration for preventing fluctuations of air-fuel ratio at the time of switching of the fuel injection ratio between the injectors, taking account of a difference in time required until the fuel injected from the respective injectors is introduced into the cylinder.

SUMMARY OF THE INVENTION

As described above, in the internal combustion engine using both the in-cylinder injector and the intake manifold injector, it is necessary to control the fuel injection ratio between the injectors. Normally, the way of setting the fuel injection ratio to obtain a preferable operation state of the internal combustion engine differs between the idle state where the required engine output is very small and the non-idle state where an engine output corresponding to the manipulation of the accelerator pedal is required.

As such, for the fuel injection ratio control, different control methods are required for the idle state and the non-idle state. When transition between the idle state and the non-idle state occurs frequently, the set value of the fuel injection ratio will be changed frequently, which may deteriorate combustion efficiency due to instability of the air-fuel ratio or the like, thereby causing variation in engine output. Such a problem is noticeable particularly in the engine cold state where fuel deposition, which would disturb the air-fuel ratio control, is likely to occur.

The present invention has been made to solve the above-described problem. An object of the present invention is to provide a control apparatus for an internal combustion engine provided with a first fuel injection mechanism (in-cylinder injector) for injecting fuel into a cylinder and a second fuel injection mechanism (intake manifold injector) for injecting fuel into an intake manifold, that can stabilize fuel injection ratio control with the control methods changed in accordance with the idle state and the non-idle state, to thereby prevent variation in engine output.

The present invention provides a control apparatus for an internal combustion engine having a first fuel injection mechanism for injecting fuel into a cylinder and a second fuel injection mechanism for injecting fuel into an intake manifold, which includes a state determination portion, a first fuel injection ratio control portion, a second fuel injection ratio control portion, a first selecting portion, and a second selecting portion. The state determination portion determines whether the internal combustion engine is in an idle state or in a non-idle state, based on a throttle opening degree, for example. The first fuel injection ratio control portion controls a fuel injection ratio between the first fuel injection mechanism and the second fuel injection mechanism with respect to a total fuel injection quantity required in the internal combustion engine, corresponding to the idle state, based on a condition (for example, temperature) of the internal combustion engine. The second fuel injection ratio control portion controls the fuel injection ratio, corresponding to the non-idle state, based on a condition (for example, temperature, engine speed, load factor, driver request (accelerator press-down degree), transmission or the like) of the internal combustion engine. The first selecting portion fixedly selects the second fuel injection ratio control portion to set the fuel injection ratio during a prescribed period (transition delay period) after transition from the non-idle state to the idle state in an engine cold state. The second selecting portion selects one of the first and second fuel injection ratio control portions to set the fuel injection ratio in accordance with a determination result of the state determination portion during a period other than the prescribed period.

According to the control apparatus for an internal combustion engine described above, fuel injection ratio control (DI ratio control) is carried out in accordance with different control methods in the idle state and in the non-idle state. In the engine cold state where fuel deposition, disturbing the air-fuel ratio control, is likely to occur, the control methods are changed frequently in response to transition between the idle state and the non-idle state. This can prevent intermittent and discontinuous changes of the fuel injection ratio within a short time period, and thus, can prevent the undesirable situation where favorable control of the air-fuel ratio becomes difficult due to the change in condition of fuel deposition onto the wall surfaces attributable to discontinuous changes of fuel injection ratio (DI ratio) setting in the engine cold state. As a result, it is possible to prevent degradation in controllability of the air-fuel ratio, to thereby prevent variation in engine output.

Preferably, in the control apparatus for an internal combustion engine according to the present invention, the first fuel injection ratio control portion sets the fuel injection ratio such that the total fuel injection quantity required is injected from the second fuel injection mechanism in the engine cold state.

According to the control apparatus for an internal combustion engine described above, in the engine cold state where atomization of the fuel within the cylinder is unlikely to be promoted, in-cylinder injection from the first fuel injection mechanism is not performed. Accordingly, it is possible to prevent degradation in exhaust emission performance as well as degradation in lubrication performance due to the fuel deposited inside the cylinder (inside the combustion chamber).

Still preferably, in the control apparatus for an internal combustion engine according to the present invention, a length of the prescribed period is set in a variable manner based on a predicted quantity of the fuel deposited in the intake manifold at the time of transition from the non-idle state to the idle state. In this case, particularly, the predicted quantity of the deposited fuel is calculated based on at least a throttle opening degree immediately before the time of the transition.

According to the control apparatus for an internal combustion engine described above, the length of the prescribed period (transition delay period), during which the fuel injection ratio (DI ratio) control method is fixed irrespective of the transition from the non-idle state to the idle state, can be set taking account of the point that fluctuations of the air-fuel ratio are likely to occur as the quantity of the deposited fuel is greater at the time of the transition. As a result, it is possible to prevent the intermittent changes of the fuel injection ratio (DI ratio) setting more reliably, and thus, to prevent deterioration in controllability of the air-fuel ratio, i.e., variation in-engine output.

Accordingly, a main advantage of the present invention is that, in an internal combustion engine provided with a first fuel injection mechanism (in-cylinder injector) for injecting fuel into a cylinder and a second fuel injection mechanism (intake manifold injector) for injecting fuel into an intake manifold, fuel injection ratio control using different control methods for the idle state and the non-idle state can be performed stably, particularly in the engine cold state, so that variation in engine output can be prevented.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
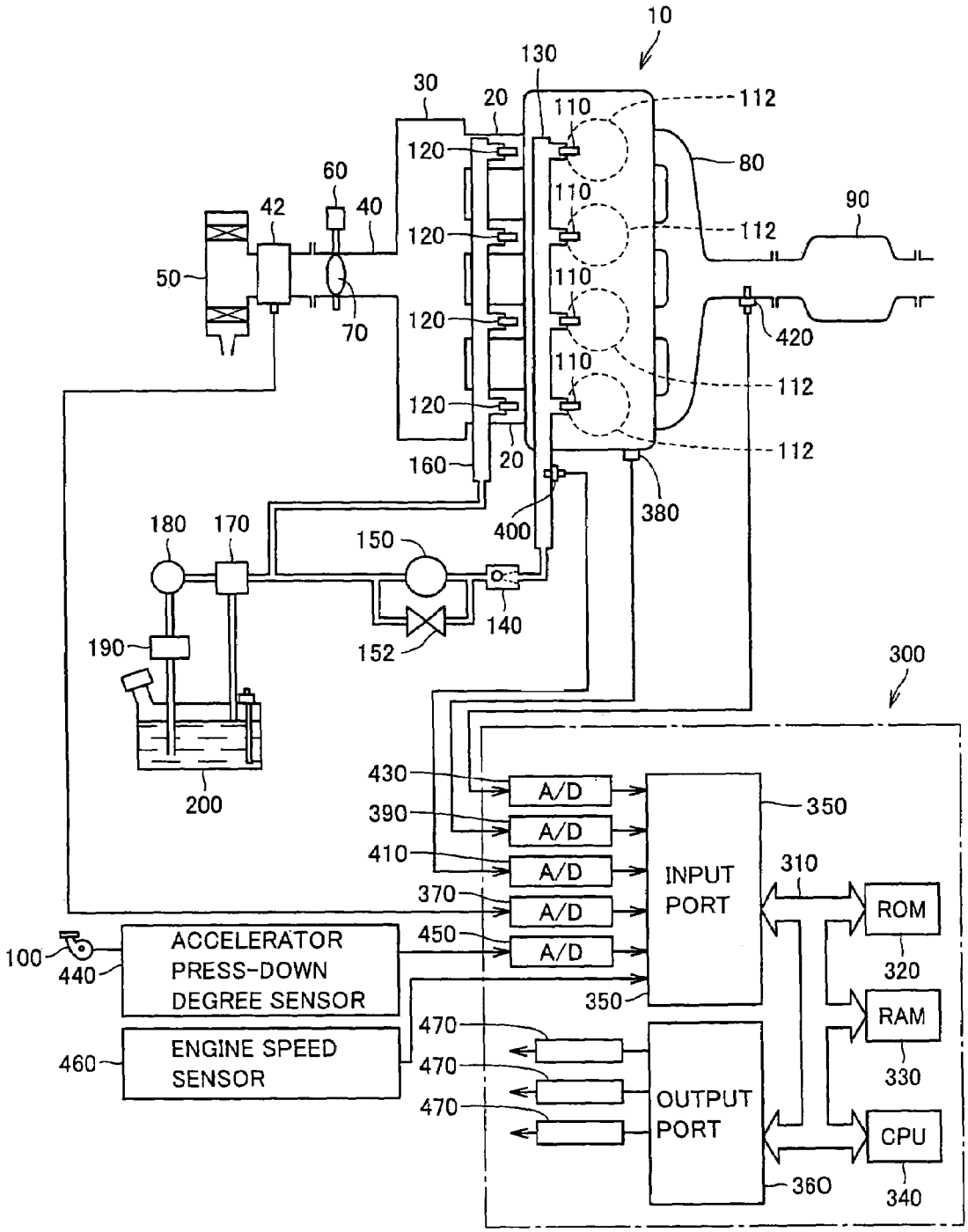
FIG. 1 is a schematic configuration diagram of an engine system that is controlled by an engine ECU (Electronic Control Unit) identified as a control apparatus for an internal combustion engine according to an embodiment of the present invention.

Hereinafter, an embodiment of the present invention will be described in detail with reference to the drawings. In the following, the same or corresponding portions in the drawings have the same reference characters allotted, and detailed description thereof will not be repeated where appropriate.

FIG. 1 is a schematic configuration diagram of an engine system that is controlled by an engine ECU (Electronic Control Unit) implementing the control apparatus for an internal combustion engine according to an embodiment of the present invention. Although an in-line 4-cylinder gasoline engine is shown in FIG. 1, application of the present invention is not restricted to the engine shown.

As shown in FIG. 1, the engine (internal combustion engine) 10 includes four cylinders 112, which are connected via corresponding intake manifolds 20 to a common surge tank 30. Surge tank 30 is connected via an intake duct 40 to an air cleaner 50. In intake duct 40, an airflow meter 42 and a throttle valve 70, which is driven by an electric motor 60, are disposed. Throttle valve 70 has its degree of opening controlled based on an output signal of an engine ECU 300, independently from an accelerator pedal 100. Cylinders 112 are connected to a common exhaust manifold 80, which is in turn connected to a three-way catalytic converter 90.

For each cylinder 112, an in-cylinder injector 110 for injecting fuel into the cylinder and an intake manifold injector 120 for injecting fuel into an intake port and/or an intake manifold are provided. Injectors 110 and 120 are controlled based on output signals from engine ECU 300.

Although an internal combustion engine having two injectors separately provided is explained in the present embodiment, the present invention is not restricted to such an internal combustion engine. For example, the internal combustion engine may have one injector that can effect both in-cylinder injection and intake manifold injection.

As shown in FIG. 1, in-cylinder injectors 110 are connected to a common fuel delivery pipe 130. Fuel delivery pipe 130 is connected to a high-pressure fuel pump 150 of an engine-driven type, via a check valve 140 that allows a flow in the direction toward fuel delivery pipe 130. The discharge side of high-pressure fuel pump 150 is connected via an electromagnetic spill valve 152 to the intake side of high-pressure fuel pump 150. As the degree of opening of electromagnetic spill valve 152 is smaller, the quantity of the fuel supplied from high-pressure fuel pump 150 into fuel delivery pipe 130 increases. When electromagnetic spill valve 152 is fully open, the fuel supply from high-pressure fuel pump 150 to fuel delivery pipe 130 is stopped. Electromagnetic spill valve 152 is controlled based on an output signal of engine ECU 300.

Intake manifold injectors 120 are connected to a common fuel delivery pipe 160 on a low pressure side. Fuel delivery pipe 160 and high-pressure fuel pump 150 are connected via a common fuel pressure regulator 170 to a low-pressure fuel pump 180 of an electric motor-driven type. Further, low-pressure fuel pump 180 is connected via a fuel filter 190 to a fuel tank 200. Fuel pressure regulator 170 is configured to return a part of the fuel discharged from low-pressure fuel pump 180 back to fuel tank 200 when the pressure of the fuel discharged from low-pressure fuel pump 180 is higher than a preset fuel pressure. This prevents both the pressure of the fuel supplied to intake manifold injector 120 and the pressure of the fuel supplied to high-pressure fuel pump 150 from becoming higher than the above-described preset fuel pressure.

Engine ECU 300 is implemented with a digital computer, and includes a ROM (Read Only Memory) 320, a RAM (Random Access Memory) 330, a CPU (Central Processing Unit) 340, an input port 350, and an output port 360, which are connected to each other via a bidirectional bus 310.

Airflow meter 42 generates an output voltage that is proportional to an intake air quantity, and the output voltage of airflow meter 42 is input via an A/D converter 370 to input port 350. A coolant temperature sensor 380 is attached to engine 10, which generates an output voltage proportional to an engine coolant temperature. The output voltage of coolant temperature sensor 380 is input via an A/D converter 390 to input port 350.

A fuel pressure sensor 400 is attached to fuel delivery pipe 130, which generates an output voltage proportional to a fuel pressure in fuel delivery pipe 130. The output voltage of fuel pressure sensor 400 is input via an A/D converter 410 to input port 350. An air-fuel ratio sensor 420 is attached to exhaust manifold 80 located upstream of three-way catalytic converter 90. Air-fuel ratio sensor 420 generates an output voltage proportional to an oxygen concentration in the exhaust gas, and the output voltage of air-fuel ratio sensor 420 is input via an A/D converter 430 to input port 350.

Air-fuel ratio sensor 420 in the engine system of the present embodiment is a full-range air-fuel ratio sensor (linear air-fuel ratio sensor) that generates an output voltage proportional to an air-fuel ratio of the air-fuel mixture burned in engine 10. As air-fuel ratio sensor 420, an $O_2$ sensor may be used which detects, in an on/off manner, whether the air-fuel ratio of the mixture burned in engine 10 is rich or lean with respect to a theoretical air-fuel ratio.

Accelerator pedal 100 is connected to an accelerator press-down degree sensor 440 that generates an output voltage proportional to the degree of press-down of accelerator pedal 100. The output voltage of accelerator press-down degree sensor 440 is input via an A/D converter 450 to input port 350. An engine-speed sensor 460 generating an output pulse representing the engine speed is connected to input port 350. ROM 320 of engine ECU 300 prestores, in the form of a map, values of fuel injection quantity (total fuel injection quantity) that are set corresponding to operation states based on the engine load factor and the engine speed obtained by the above-described accelerator press-down degree sensor 440 and engine speed sensor 460, respectively, and the correction values based on the engine coolant temperature.

Engine ECU 300 generates various control signals for controlling the overall operations of the engine system based on signals from the respective sensors by executing a prescribed program. The control signals are transmitted to the devices and circuits constituting the engine system via output port 360 and drive circuits 470.

In engine 10 according to the embodiment of the present invention, both of in-cylinder injector 110 and intake manifold injector 120 are provided for each cylinder 112. Thus, it is necessary to control a fuel injecltion ratio between in-cylinder injector 110 and intake manifold injector 120 with respect to a total fuel injection quantity required.

Hereinafter, the fuel injection ratio between the injectors will be represented as a DI (Direct Injection) ratio r, which is a ratio of the quantity of the fuel injected from in-cylinder injector 110 with respect to a total fuel injection quantity required. More specifically, "DI ratio r=100%" means that fuel is injected only from in-cylinder injector 110, and "DI ratio r=0%" means that fuel is injected only from intake manifold injector 120. "DI ratio r≠0%", "DI ratio r≠100%", and "0%<DI ratio r<100%" each mean that fuel injection is carried out using both in-cylinder injector 110 and intake manifold injector 120. Generally, in-cylinder injector.110 contributes to an increase in output performance, while intake manifold injector 120 contributes to homogeneity of the air-fuel mixture.

Figure 2:
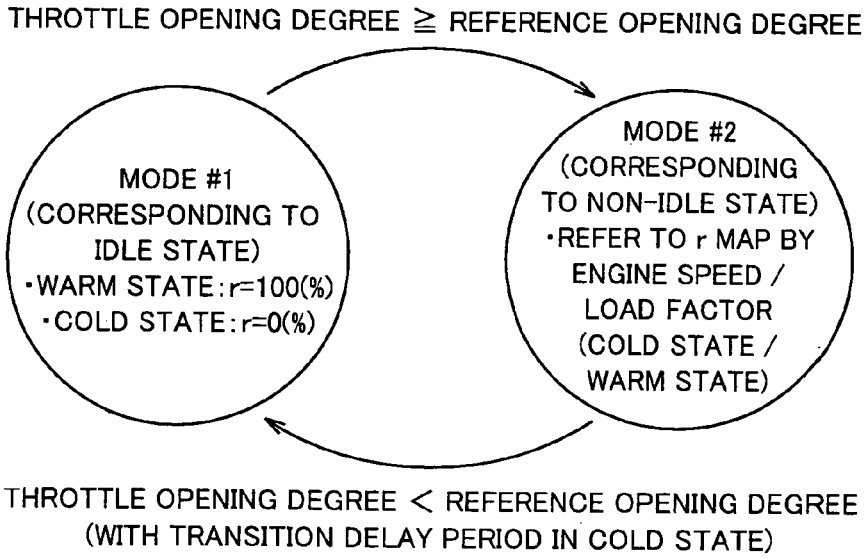
FIG. 2 is a conceptual diagram illustrating DI ratio control by the control apparatus for an internal combustion engine according to the embodiment of the present invention.

FIG. 2 is a conceptual diagram illustrating DI ratio control according to the embodiment of the present invention.

Referring to FIG. 2, in the control apparatus for an internal combustion engine of the present invention, the DI ratio control takes two modes: a mode #1 corresponding to the idle state; and a mode #2 corresponding to the non-idle state. That is, the DI ratio control, or, fuel injection ratio control, is conducted by different control methods in mode #1 and in mode #2.

In mode #1 corresponding to the idle state, almost no engine output is required. Thus, a preferable DI ratio is set based on the engine temperature condition.

More specifically, in the engine cold state, atomization of the fuel in the cylinder is unlikely to be promoted, and thus, the fuel injected from the in-cylinder injector tends to be deposited on the top face of the engine piston (piston top face) and the inner peripheral surface of the cylinder (cylinder inner peripheral surface) in a large quantity. The fuel deposited on the piston top face will be gradually atomized during the subsequent engine combustion, causing incomplete combustion, which may lead to generation of black smoke or increase of un-burned components, thereby causing deterioration in exhaust emission performance. Further, the fuel deposited on the cylinder inner peripheral surface will be mixed with the lubricating oil of the engine piston, causing dilution of the lubricating oil, which may lead to degradation in lubrication performance. As such, it is preferable to avoid fuel injection from in-cylinder injector 110 in the engine cold state.

On the other hand, in the engine warm state, if the fuel injection is carried out only from the intake manifold injector, the in-cylinder injector will be constantly exposed to a high-temperature combustion gas, and the cooling effect by vaporization of the injected fuel cannot be obtained. With the tip end of the in-cylinder injector exposed to the high temperature, deposition of the fuel in the injection hole thereof is likely to take place. As such, it is preferable to carry out fuel injection via in-cylinder injector 110 in the engine warm state.

Thus, in mode #1, fuel injection is controlled in accordance with the engine coolant temperature that is measured by coolant temperature sensor 380. In the engine warm state, DI ratio r is set to 100%, and in-cylinder injection alone is carried out. In the engine cold state, DI ratio r is set to 0%, and intake manifold injection (port injection) alone is carried out.

By comparison, in mode #2 corresponding to the non-idle state, DI ratio r is set in accordance with a map that is prepared to reflect not only the engine temperature but also other engine conditions (engine speed, load factor and others), so as to obtain a favorable combustion state.

Herein, for example, the idle state and the non-idle state are determined based on comparison between the degree of opening of throttle valve 70 (throttle opening degree) and a reference opening degree. The reference opening degree is set to a value that is obtained by adding a prescribed value to the "idle opening degree" corresponding to the throttle opening degree required to maintain a target idle engine speed in the state of accelerator press-down degree=0. The target idle engine speed is set to different values according to the coolant temperature, air conditioning load, electricity load and others, and thus, the above-described idle opening degree also changes in accordance with the situations.

As described above, the DI ratio control according to the embodiment of the present invention is carried out using different control methods in the idle state and in the non-idle state. This means-that the DI ratio set values are basically discontinuous upon transition between mode #1 and mode #2. Thus, frequent transition between modes #1 and #2 within a short time period will cause intermittent changes of the DI ratio set value.

In the engine cold state, deposition of the fuel injected from injectors 110, 120 on the wall surfaces is likely to occur both in the cylinder and in the intake manifold. Thus, if the DI ratio set value changes intermittently, the condition of deposition of the fuel on the wall surfaces changes correspondingly, in which case the air-fuel ratio is likely to vary. That is, in the engine cold state where port injection alone is carried out in mode #1 (in the idle state), if there occurs frequent transition within a short time period between mode #1 and mode #2 (non-idle state) where DI ratio r may be set to more than 0%, favorable control of the air-fuel ratio would be difficult due to the change in condition of fuel deposition in the intake manifold. In view of the foregoing, in the present embodiment, a transition delay period is provided in DI ratio control mode setting in the engine cold state, which will now be described.

Figure 3:
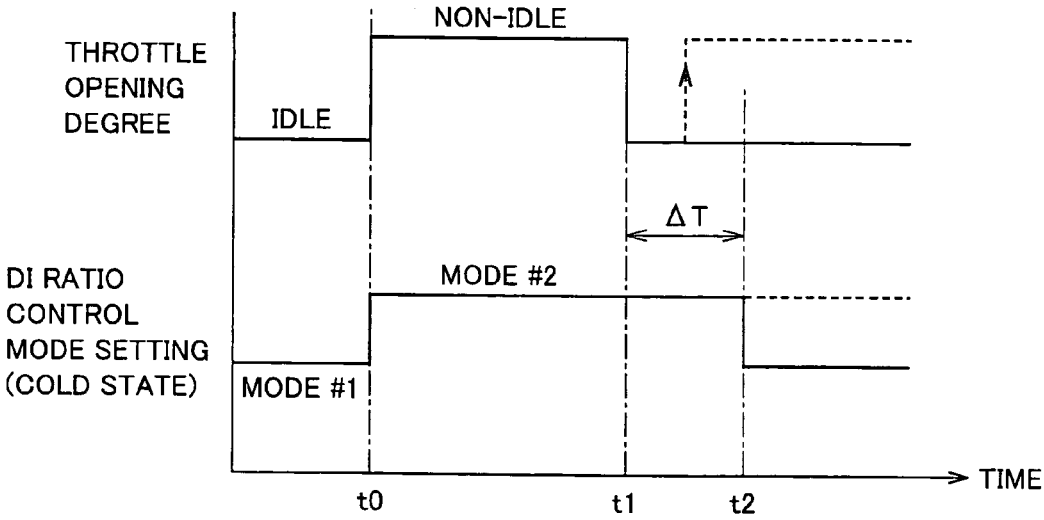
FIG. 3 is a waveform diagram illustrating an example of mode switching in the engine cold state in the DI ratio control according to the embodiment of the present invention.

FIG. 3 shows an example of mode switching in the engine cold state in the DI ratio control according to the embodiment of the present invention.

Referring to FIG. 3, at time t0, the throttle opening degree becomes greater than a reference opening degree, and engine 10 switches from the idle state to the non-idle state. In response, the DI ratio control changes from mode #1 corresponding to the idle state, to mode #2. While port injection alone is carried out prior to time t0 in mode #1, after t0, both of in-cylinder injection and port injection become possible.

At time t1, the throttle opening degree becomes smaller than the reference opening degree, and engine 10 switches from the non-idle state to the idle state again. In the engine cold state, however, transition of the DI ratio setting mode does not immediately follow the transition from the non-idle state to the idle state. Specifically, during a prescribed period after the transition from the non-idle state to the idle state, i.e., during a period from time t1 to time t2 when a prescribed transition delay period ΔT elapses, transition of the DI ratio setting mode is not made, with the DI ratio control mode being fixed to mode #2.

At time t2 at the end of transition delay period ΔT, it is determined again whether engine 10 is in the idle state or in the non-idle state, based on the throttle opening degree at that time point. If the throttle opening degree is less than the reference opening degree at this time point (idle state), the DI ratio control mode is returned to mode #1.

On the contrary, if the throttle opening degree becomes equal to or greater than the reference opening degree (non-idle state) again during the period from time t1 to time t2 and the non-idle state is maintained at time t2 (shown by a broken line in FIG. 3), then the DI ratio control mode is maintained at mode #2 even after time t2.

With such DI ratio control, it is possible to prevent intermittent and discontinuous changes of DI ratio r within a short time period in the engine cold state, due to frequently repeated transition between the idle state and the non-idle state and frequent switching of the DI ratio control modes corresponding thereto. As such, it is possible to prevent deterioration in controllability of the air-fuel ratio, to thereby prevent variation in engine output.

In the engine warm state, fuel deposition is unlikely to occur. Further, during the idle operation, aggressive in-cylinder injection is required to prevent clogging of in-cylinder injector 110. Thus, in the engine warm state, the DI ratio control mode setting is carried out immediately in response to the transition between the idle state and the non-idle state, without provision of the transition delay period as described above.

Figure 4:
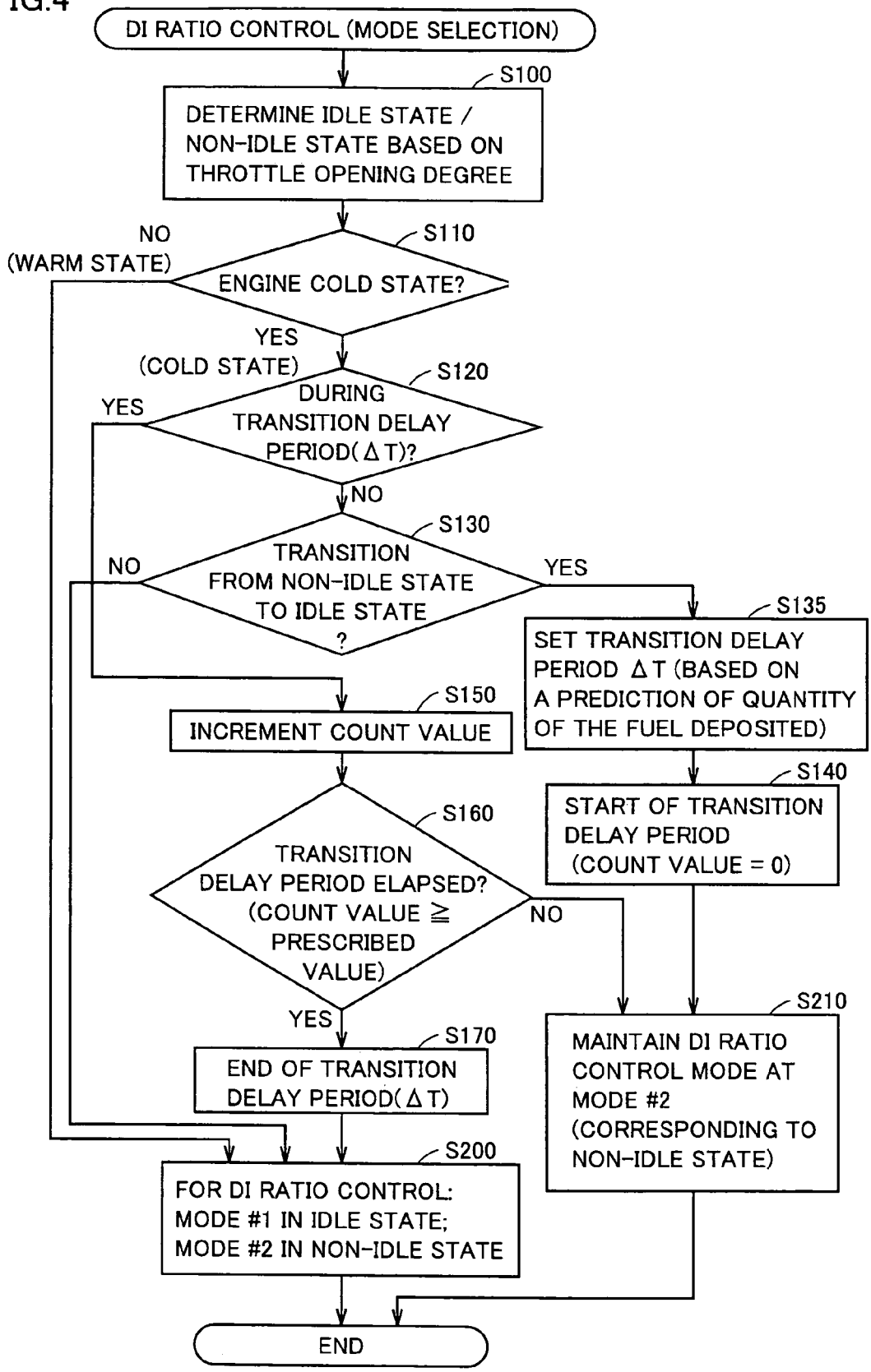
FIG. 4 is a flowchart illustrating DI ratio control (mode selection) by the control apparatus for an internal combustion engine according to the embodiment of the present invention.

FIG. 4 is a flowchart illustrating DI ratio control (mode selection) by the control apparatus for an internal combustion engine according to the present invention. The mode selection for DI ratio setting according to the flowchart in FIG. 4 is carried out by activation of a program preinstalled in engine ECU 300.

Referring to FIG. 4, according to the DI ratio control of the present embodiment, it is determined whether engine 10 is in the idle state or in the non-idle state based on the throttle opening degree, or more specifically by comparison between the throttle opening degree and the reference opening degree (step S100). Further, it is determined whether it is in the engine cold state or not based on the engine coolant temperature measured by coolant temperature sensor 380 (step S110).

In the engine warm state (NO in step S110), the DI ratio control mode is selected in accordance with the state determined in step S100. That is, the DI ratio is set in accordance with mode #1 in the idle state, while it is selected in accordance with mode #2 in the non-idle state (step S200), and the mode setting for the DI ratio control is terminated.

On the other hand, in the engine cold state (YES in step S110), it is determined whether it is during the transition delay period ΔT shown in FIG. 3 (step S120).

If it is not during the transition delay period ΔT (NO in step S120), it is determined whether there was transition from the non-idle state to the idle state based on the determination in step S100 (step S130). That is, it is determined whether there was a change of the throttle opening degree as in time t1 in FIG. 3.

If there was no transition from the non-idle state to the idle state (NO in step S130), the DI ratio control mode is selected in accordance with the state determined in step S100 (step S200), and the mode setting for the DI ratio control is terminated.

On the other hand, if there was transition from the non-idle state to the idle state (YES in step S130), the length of transition delay period ΔT is set (step S135), and transition delay period ΔT is started. A count value for detecting a lapse of ΔT is reset (count value=0) (step S140). At this time, for the DI ratio control, mode #2 corresponding to the non-idle state is fixedly selected, despite the transition to the idle state (step S210), and the mode setting for the DI ratio control is terminated.

When the transition delay period starts, the determination in step S120 is YES, and the count value is incremented each time (step S150). It is determined whether transition delay period ΔT has elapsed or not by comparing the count value with a prescribed value (step S160). For the count value, besides the time, the number of times of engine ignition or the like may be employed.

Thus, until prescribed period ΔT has elapsed from the start of the transition delay period (NO in step S160), the step S210 is carried out and the DI ratio setting is fixed to mode #2 corresponding to the non-idle state. The mode setting for the DI ratio control is then terminated.

On the other hand, when prescribed period ΔT has-passed from the start of the transition delay period (YES in step S160), the transition delay period expires. (step S170), and step S200 is carried out. As such, the DI ratio control mode is set to mode #1 in the idle state and set to mode #2 in the non-idle state, in accordance with the determination in step S100, i.e., based on the throttle opening degree at the time point, and the mode setting for the DI ratio control is terminated.

The mode selection for the DI ratio control according to the above-described flowchart implements the DI ratio setting mode selection shown in FIGS. 2 and 3. As a result, in the internal combustion engine according to the present embodiment, it is possible to prevent intermittent and discontinuous changes of DI ratio r within a short time period in the engine cold state, due to frequent switching of the DI ratio control mode in response to the transition between the idle state and the non-idle state. Accordingly, it is possible to prevent deterioration in controllability of the air-fuel ratio, and thus, to prevent variation in engine output.

For setting of transition delay period ΔT (step S135), besides setting of a prescribed fixed value as described above, variable setting in accordance with the engine conditions may be employed. For example, the length of the transition delay period may be determined taking account of the fact that fluctuations of the air-fuel ratio are more likely to occur as the fuel deposited in the intake manifold at the start of the transition delay period is greater in quantity. Specifically, intake air quantity (throttle opening degree), engine load, fuel injection quantity, engine coolant temperature and others may be used as parameters for predicting the quantity of the fuel deposited, and the length of the transition delay period may be determined in accordance with these prediction parameters. In this case, a table for determination of the length of the transition delay period (ΔT) with respect to the prediction parameters, for example, may be prepared in advance, and the length of the transition delay period may be determined based thereon.

In the configuration of the embodiment described above, in-cylinder injector 110 and intake manifold injector 120 correspond to the "first fuel injection means" and the "second fuel injection means", respectively, of the present invention. Further, in the DI ratio control, mode #1 (FIG. 2) and mode #2 (FIG. 2) correspond to the "first fuel injection ratio control means" and the "second fuel injection ratio control means", respectively, of the present invention.

Furthermore, in the flowchart shown in FIG. 4, step S100 corresponds to the "state determination means" of the present invention, and step S210 and step S200 correspond to the "first selecting means" and the "second selecting means", respectively, of the present invention.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus for an internal combustion engine having first fuel injection means for injecting fuel into a cylinder and second fuel injection means for injecting fuel into an intake manifold, comprising:

state determination means for determining whether said internal combustion engine is in an idle state or in a non-idle state;

first fuel injection ratio control means for controlling a fuel injection ratio between said first fuel injection means and said second fuel injection means with respect to a total fuel injection quantity required in said internal combustion engine, corresponding to said idle state, based on a condition of said internal combustion engine;

second fuel injection ratio control means for controlling said fuel injection ratio, corresponding to said non-idle state, based on a condition of said internal combustion engine;

first selecting means for selecting said second fuel injection ratio control means to set said fuel injection ratio during a prescribed period after transition from said non-idle state to said idle state during an engine cold state; and second selecting means for selecting one of said first and second fuel injection ratio control means to set said fuel injection ratio in accordance with a determination result of said state determination means during a period other than said prescribed period.

2. The control apparatus for an internal combustion engine according to claim 1, wherein said first fuel injection ratio control means sets said fuel injection ratio such that said total fuel injection quantity required is injected from said second fuel injection means in said engine cold state.

3. The control apparatus for an internal combustion engine according to claim 1, wherein a length of said prescribed period is set in a variable manner based on a predicted quantity of the fuel deposited in said intake manifold at the time of transition from said non-idle state to said idle state.

4. The control apparatus for an internal combustion engine according to claim 3, wherein said predicted quantity of the deposited fuel is calculated based on at least a throttle opening degree immediately before the time of said transition.

5. A control apparatus for an internal combustion engine having a first fuel injection mechanism for injecting fuel into a cylinder and a second fuel injection mechanism for injecting fuel into an intake manifold, comprising:

a state determination portion for determining whether said internal combustion engine is in an idle state or in a non-idle state;

a first fuel injection ratio control portion for controlling a fuel injection ratio between said first fuel injection mechanism and said second fuel injection mechanism with respect to a total fuel injection quantity required in said internal combustion engine, corresponding to said idle state, based on a condition of said internal combustion engine;

a second fuel injection ratio control portion for controlling said fuel injection ratio, corresponding to said non-idle state, based on a condition of said internal combustion engine;

a first selecting portion for selecting said second fuel injection ratio control portion to set said fuel injection ratio during a prescribed period after transition from said non-idle state to said idle state in an engine cold state; and a second selecting portion for selecting one of said first and second fuel injection ratio control portions to set said fuel injection ratio in accordance with a determination result of said state determination portion during a period other than said prescribed period.

6. The control apparatus for an internal combustion engine according to claim 5, wherein said first fuel injection ratio control portion sets said fuel injection ratio such that said total fuel injection quantity required is injected from said second fuel injection mechanism in said engine cold state.

7. The control apparatus for an internal combustion engine according to claim 5, wherein a length of said prescribed period is set in a variable manner based on a predicted quantity of the fuel deposited in said intake manifold at the time of transition from said non-idle state to said idle state.

8. The control apparatus for an internal combustion engine according to claim 7, wherein said predicted quantity of the deposited fuel is calculated based on at least a throttle opening degree immediately before the time of said transition.

* * * * *